United States Patent [19]

Crittenden

[11] Patent Number: 4,964,664

[45] Date of Patent: Oct. 23, 1990

[54] MULTIPLE LEVER SIDE POLE WRENCH

[76] Inventor: John P. Crittenden, South Cross Rd., Staatsburg, N.Y. 12580

[21] Appl. No.: 378,700

[22] Filed: Jul. 11, 1989

[51] Int. Cl.[5] ..... B66C 1/00; E04H 15/32

[52] U.S. Cl. ..... 294/15; 294/92

[58] Field of Search ..... 294/15, 17, 92, 1.1, 294/19.1; 81/119, 125.1, 176.1, 177.5; 135/905

[56] References Cited

U.S. PATENT DOCUMENTS

| | | | |
|---|---|---|---|
| 58,313 | 9/1866 | Soumeillian | 81/119 X |
| 2,427,104 | 9/1947 | Hosler | 294/92 X |
| 4,059,033 | 11/1977 | Johnson | 81/176.1 X |
| 4,645,224 | 2/1987 | Poganski | 294/15 X |
| 4,802,391 | 2/1989 | Willhoite et al. | 294/19.1 X |

*Primary Examiner*—Margaret A. Focarino
*Assistant Examiner*—Dean J. Kramer
*Attorney, Agent, or Firm*—Shlesinger & Myers

[57] ABSTRACT

A wrench for use in the erecting of tent poles, characterized in that a tent pole of considerable height may be erected by several persons applying pressure to the individual lever arms of the wrench to thereby position the tent pole erectly. The wrench is designed for use with tent poles having a hole therethrough. The wrench has a complementary projection extending from one of its lever arms for insertion into the complimentary hole of the tent pole.

10 Claims, 1 Drawing Sheet

MULTIPLE LEVER SIDE POLE WRENCH

FIELD OF THE INVENTION

This invention relates to a hand tool which is characterized by a plurality of lever arms connected to a plate and one of the arms extends perpendicularly through the plate for insertion into a complementary hole of a tent pole. This device permits several persons to simultaneously exert upward pressure on a tent pole to erect the pole in proper vertical position.

BACKGROUND OF THE INVENTION

It is common practice to use large tents at outdoor events to provide protection for guests from sun and rain. These large tents are usually held up by tent poles. The tent poles used to hold up the tent are commonly quite tall to hold the tent high above the occupants and may be several inches in diameter. Consequently, poles of this size tend to be rather heavy and require several persons to erect. It is difficult for several persons to grasp the same pole and be able to exert a maximum force to lift the pole upward into a vertical orientation.

In view of the above, it can seen that there is a need for a device which allows several persons to exert a maximum uplifting force on a tent pole in order to erect the pole into proper position. The disclosed invention provides just such a device and achieves a greater application of force than can be achieved by pushing directly on a pole with hands.

OBJECTS AND SUMMARY OF THE INVENTION

The primary object of the disclosed invention is to provide a wrench which achieves a higher degree of application of force to the tent pole.

Another object of the present invention is to provide a wrench which will securely engage the tent pole for lifting.

Yet another object of the present invention is to provide tent pole erecting device which allows several persons to apply a maximum force to the lifting of the tent pole.

Still another object of the present invention is to provide a device which will prevent the pole from twisting relative to the wrench as it is being lifted.

Another object of the present invention is to provide a tent pole erection device which securely engages the tent pole at a specific point and eliminates vertical slippage of the device on the pole by insertion of a portion of the device through an opening in the pole.

In summary, therefore, this invention is directed to a wrench for use in the erection of tent poles. The wrench includes an elongated bar or lever having a portion for extending through a tent pole and having a handle portion. A pole engaging means is rigidly attached to the handle and the elongated handle extends through the surface of the pole engaging means for insertion in a tent pole.

These and other objects and advantages of the invention will be readily apparent in view of the following description and drawings of the above-described invention.

DESCRIPTION OF THE DRAWINGS

The above and other objects and advantages and novel features of the following detailed description of the preferred embodiment of the invention illustrated in the accompanying drawings, wherein.

DESCRIPTION OF THE INVENTION

Figure 1:
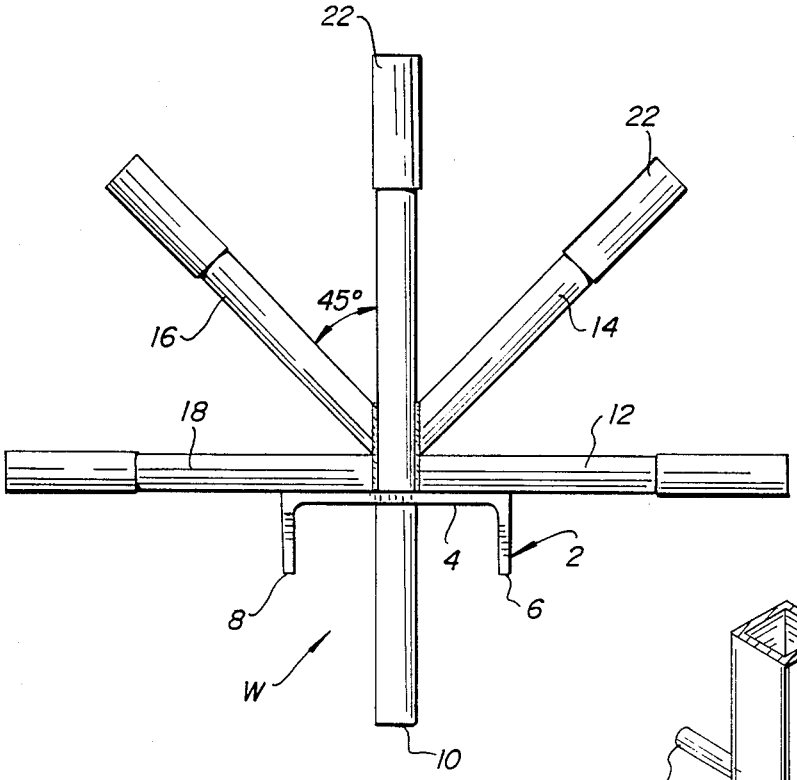
FIG. 1 is a top plan view of the preferred embodiment of the invention.
Figure 2:
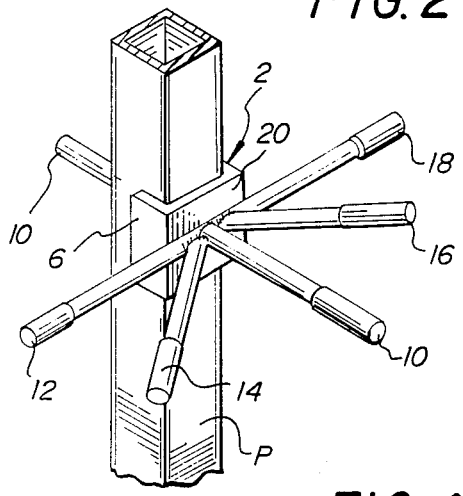
FIG. 2 is a perspective fragmentary view of the multiple lever box wrench inserted into a tent pole of indeterminate length and shown partially in section.

As best shown in FIGS. 1 and 2, the multiple lever box wrench W includes a U-shaped pole engaging portion 2 having a front surface 4 and a pair of perpendicularly extending wings 6 and 8. Central bar or lever 10 extends through the center of front surface 4 of pole engaging portion 2 and extends parallel to wings 6 and 8. Side bars or levers 12, 14, 16 and 18 all lie in the same plane and are connected to the back surface 20 of U-shaped pole engaging portion 2. Preferably, bars 10, 12, 14, 16 and 18 extend an equal distance from back surface 20 and are joined together by suitable welds where they converge at back surface 20. Bars 10, 12, 14, 16 and 18 extend angularly approximately 45 degrees from each other. Each of bars 10, 12, 14, 16 and 18 include a handle portion 22 for gripping the wrench W, preferably formed of rubber, although plastic material may also be substituted.

Figure 3:
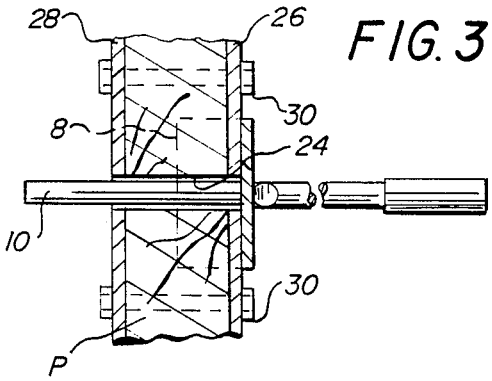
FIG. 3 is a cross sectional fragmentary view of a wooden tent pole having reinforcing plates secured thereto and the wrench shown partially in section and of indeterminate length inserted in the pole.

FIGS. 2 and 3 show the multiple lever box wrench engaged with a tent pole. In FIG. 2 the multiple lever box wrench W is inserted into a metal pole P. In FIG. 3 the tent pole is made of wood. As best shown in FIG. 3, central bar 10 extends through hole 24 in pole P and front surface 4 engages one of reinforcing plates 26 and 28 which are secured to pole P by bolts 30. Wings 6 and 8 are anti-torque devices which engage the sides of pole P to prevent twisting of wrench W relative to pole P when force is applied to lift pole P. Reinforcing plates 26 and 28 are preferably attached to a wooden tent pole to prevent damage to the wood when force is applied to the wrench W. As shown in FIG. 2, the reinforcing plates 26 and 28 are not required when using a metal pole P.

Figure 4:
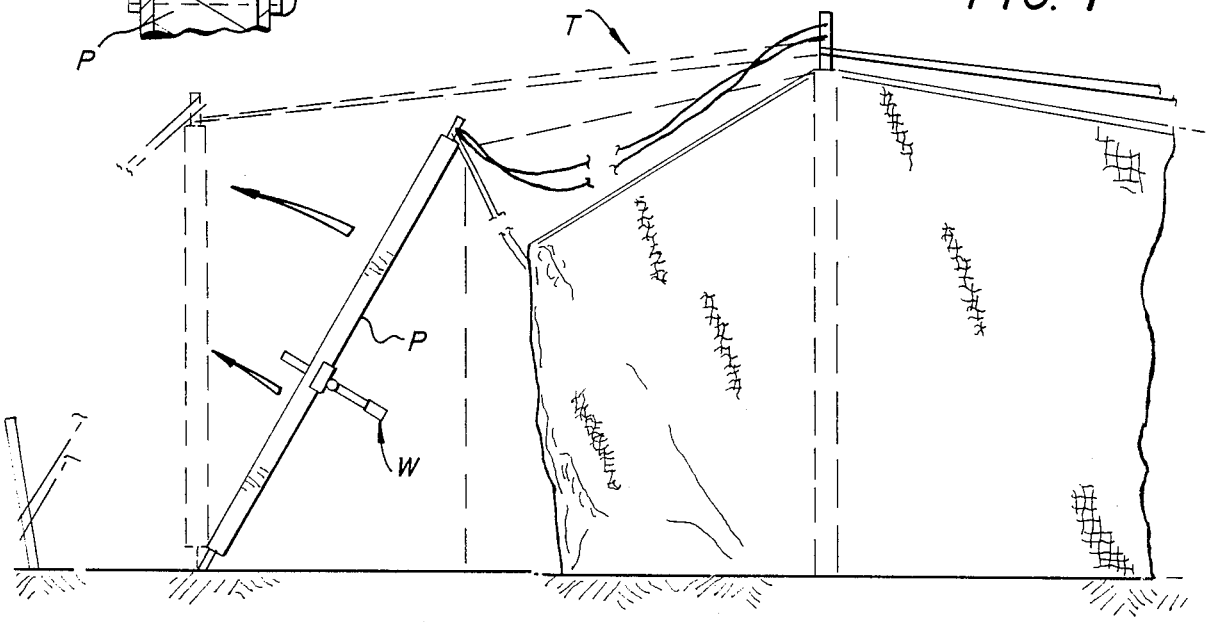
FIG. 4 shows the multiple lever box wrench used in the erection of a tent pole with arrows showing the direction of travel of the pole as it is erected and showing the associated tent structure. The erected position is shown in phantom lines.

FIG. 4 shows the multiple lever box wrench applied to pole P to lift pole P to an erect position supporting tent T.

To use the multiple lever box wrench W, central bar 10 is inserted into and through hole 24 in pole P until front surface 4 contacts pole P. When front surface 4 is in contact with pole P, wings 6 and 8 prevent twisting of the wrench W relative to pole P when wrench W is lifted by several persons standing peripherally of the pole and applying an upward force on bars 10, 12, 14, 16 and 18 to lift pole P in to an erect position. The combination of U-shaped pole engaging portion 2 and central bar 10 operate to provide a secure engagement of the wrench W with pole P so that persons attempting to erect pole P can direct their attention to applying upward force on bars 10, 12, 14, 16 and 18 without being concerned with the wrench W accidentally becoming disengaged from pole P.

The multiple lever box wrench W is preferably constructed of metal, such as steel, but may also be constructed of other suitably rigid material.

While this invention has been described as having a preferred embodiment, it is understood that it is capable of further modification, uses and/or adaptations of the invention follow in general the principle of the invention and including such departures from the present disclosure as come within known or customary practice in the art to which the invention pertains, and as may be applied to the central features herein before set-forth, and fall within the cope of the invention of the limits of the appended claims.

What is claimed:

1. A non-slip wrench for erecting a tent pole having at least one erecting opening therein, comprising:

(a) handle means;

(b) pole engaging means;

(c) said pole engaging means including a pole engaging surface;

(d) said handle means including an elongated central bar extending through said pole engaging means and being rigidly connected thereto;

(e) said central bar of said handle means extending through said pole engaging surface a substantial distance for full insertion into the tent pole opening until said pole engaging surface contacts the tent pole;

(f) said pole engaging means includes anti-torque means connected thereto for preventing twisting of the wrench relative to the tent pole when the pole is being erected;

(g) said handle means includes at least one lever extending from said pole engaging means; and (h) said at least one lever is attached to said central bar at a location where said central bar engages said back surface.

2. The wrench of claim 1, wherein:

(a) said anti-torque means includes a pair of wings extending from said pole engaging surface for engagement with the tent pole.

3. The non-slip wrench of claim 1, wherein:

(a) said handle means includes a plurality of levers extending from said pole engaging means.

4. The non-slip wrench of claim 3, wherein:

(a) said pole engaging means includes a back surface;

(b) said central bar extends outwardly from said back surface; and, (c) said levers lie in a single plane and extend angularly relative to each other from said back surface.

5. The non-slip wrench of claim 3, wherein:

(a) said one lever is attached perpendicularly to said central bar and, (b) a second lever is attached perpendicularly to said central bar at a location where said central bar engages said back surface and extends in a direction opposite said one lever.

6. The non-slip wrench of claim 5, wherein:

(a) a third lever is joined to said central bar at the location where said central bar engages said back surface; and, (b) said third lever extends between said first lever and said central bar.

7. The non-slip wrench of claim 6, wherein:

(a) a fourth lever is joined to said central bar at the location where said central bar engages said back surface; and, said fourth lever extends between said second lever and said central bar.

8. The non-slip wrench of claim 7, wherein:

(a) each of said levers extend angularly relative to each other from the location where said central bar engages said back surface.

9. The non-slip wrench of claim 8, wherein:

(a) said one lever extends from said third lever at an angle of 45 degrees;

(b) said third lever extends from said central bar at an angle of 45 degrees;

(c) said fourth lever extends from said second lever at an angle of 45 degrees;

(d) said fourth lever extends from said central bar at an angle of 45 degrees; and, (e) whereby, several persons can stand side-by-side and exert a maximum uplifting force on the wrench to lift the tent pole.

10. The non-slip wrench of claim 8, wherein:

(a) said levers and said central bar extend an equal distance from the location where said central bar engages said back surface.

* * * * *